US005251972A

United States Patent [19]

Zurawin

[11] Patent Number: 5,251,972

[45] Date of Patent: Oct. 12, 1993

[54] DEVICE FOR DISPLAYING AND DISPENSING CONSUMER PRODUCTS ON SHELVING

[76] Inventor: Michael Zurawin, 400 E. 56th St., New York, N.Y. 10022

[21] Appl. No.: 816,124

[22] Filed: Dec. 31, 1991

[51] Int. Cl.[5] ..... A47F 3/00

[52] U.S. Cl. ..... 312/118; 312/114; 312/121

[58] Field of Search ..... 312/114, 118, 120, 121, 312/122, 119, 127, 128, 129; 206/44 R, 44.11, 459.1; 211/84

[56] References Cited

U.S. PATENT DOCUMENTS

| | | | |
|---|---|---|---|
| 852,229 | 4/1907 | Joyce | 312/120 |
| 1,099,832 | 6/1914 | Warren | 312/118 |
| 1,376,506 | 5/1921 | Beskin | 312/114 |
| 1,966,676 | 7/1934 | Marsh | 312/118 |
| 2,044,288 | 6/1936 | Fry | 312/118 |
| 2,241,696 | 5/1941 | Bender | 312/118 |
| 3,990,601 | 11/1976 | Joyce | 206/44 R |
| 4,530,549 | 7/1985 | Genna | 312/121 |
| 4,805,765 | 2/1989 | Barrett et al. | 206/44.11 |

*Primary Examiner*—Victor N. Sakran
*Attorney, Agent, or Firm*—Cohen, Pontani, Lieberman, Pavane

[57] ABSTRACT

A device (10) removably matable to the front of a box (12) allows consumer products to be displayed and dispensed from the box in which they are shipped. The device (10) comprises a frame (14) including a lower front wall portion (32) spaced from the front of the box (12) for defining a compartment (36). A rear opening in the frame (14) communicates with an opening in the front of the box (12) such that products from the box pass into the compartment (36) for easy access by consumers. The device (10) is also capable of supporting interchangeable point-of-sale written materials.

16 Claims, 2 Drawing Sheets

DEVICE FOR DISPLAYING AND DISPENSING CONSUMER PRODUCTS ON SHELVING

TECHNICAL FIELD

This invention relates to devices for displaying and dispensing consumer products.

BACKGROUND ART

So-called warehouse shopper's clubs are becoming increasingly popular. A warehouse shopper's club is usually characterized by one or more centrally located spartan warehouse type facilities where warehouse case-packed goods are displayed on shelves supported by I-beams. Typically, these goods are left in the boxes in which they were originally shipped, these boxes being placed on shelves with their fronts or tops razor-cut open such that the goods may be removed for purchase by the consumer. Needless to say, this provides a rather unappealing display and limits the point-of-sale information and/or advertising available to the consumer. On the other hand, because of the nature of these warehouse retail facilities, it is not feasible to remove goods from the boxes in which they were shipped for placement in a separate display. Consequently, and as noted, the box is typically opened from the front or top and simply placed on the shelf. In either event, it will be apparent that, depending upon the level of the shelf upon which the box is placed, it may be difficult for consumers to see whether there are any products left in the box, if so, what they look like and, more importantly, what they are used for. Moreover, even when the box is opened from the front, typically only the top of the front of the box can be opened, lest the goods simply fall out of the box. This, of course, makes it even more difficult for consumers to view the products in the box.

It is accordingly an object of the present invention to provide a device usable with standardized shipping boxes to facilitate access to and viewing of the products therein.

It is a further object of the present invention to provide a device of the aforementioned type wherein the device defines an enlarged compartment communicating with an opening in the box for facilitating access to the products therein.

It is a further object of the present invention to provide a device of the aforementioned type which is inexpensive to manufacture and which provides, on its outer surface, means for displaying point-of-sale descriptive material, which material is preferably removable and interchangeable.

It is yet a further object of the present invention to provide a device of the aforementioned type wherein the device may be quickly removed from an empty box and fit onto a new, full box.

SUMMARY OF THE INVENTION

Broadly speaking, the present invention is a device for displaying and dispensing products, the device being useable with a box containing the products and having a first opening in a front wall thereof sufficient to pass the products, the device comprising a frame releasably matable to the box over the opening, the frame defining a rear opening communicating with the opening in the box, and including a lower front wall portion spaced from the front wall of the box and extending upward from the bottom of the frame for defining an open compartment between the front wall of the box and the lower front wall portion of the frame, the compartment being in communication with the rear opening in the frame whereby products from the box pass through the opening in the box and the rear opening in the frame into the open compartment for removal therefrom.

In a preferred embodiment, the frame further comprises a bottom wall for receiving the front portion of the bottom of the box and a pair of sidewalls fitable about the front portions of the sides of the box in close spaced relation thereto for releasably mating the device to the box. The device also preferably comprises an upper front wall portion in close confronting relation with the front wall of the box when the device is mated thereto and means for securing advertising material to the upper front wall portion.

Further features and advantages of the device in accordance with the present invention will be more fully apparent from the following detailed description and annexed drawings of the presently preferred embodiment thereof.

BRIEF DESCRIPTION OF THE DRAWINGS

In the drawings, wherein like numerals represent like parts.

BEST MODE FOR CARRYING OUT THE INVENTION

Figure 1:
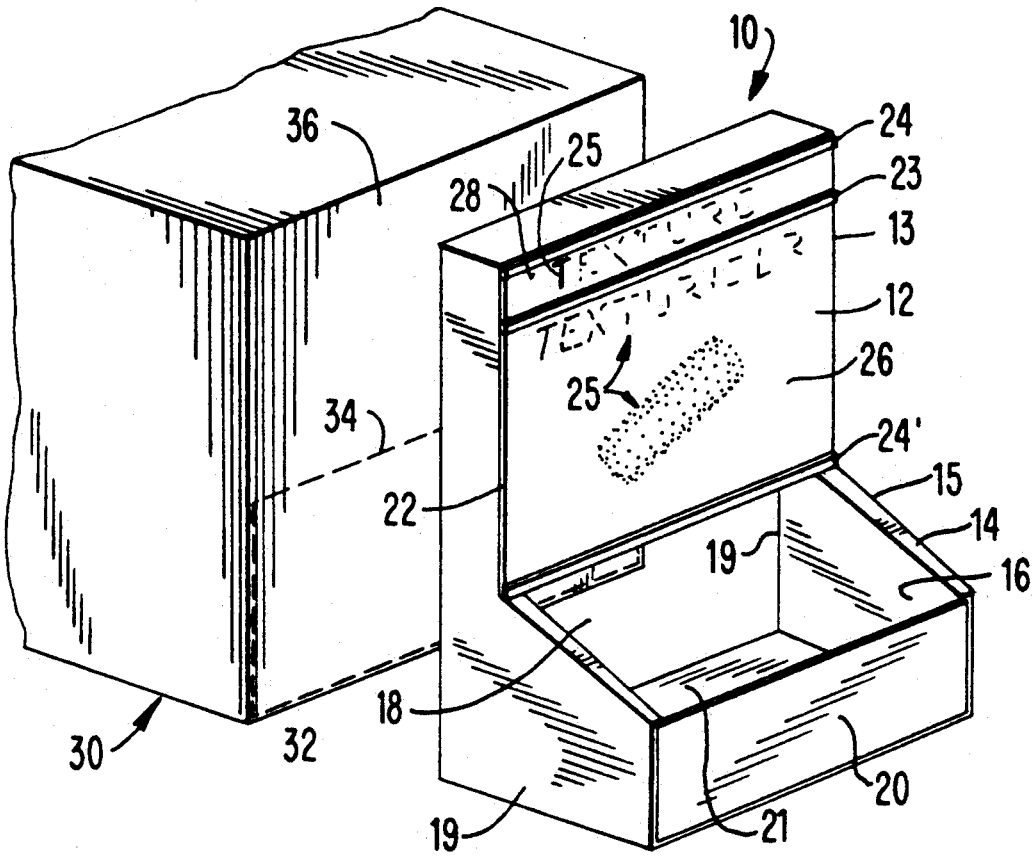
FIG. 1 is a perspective view of a preferred device for displaying and dispensing products in accordance with the present invention.
Figure 2:
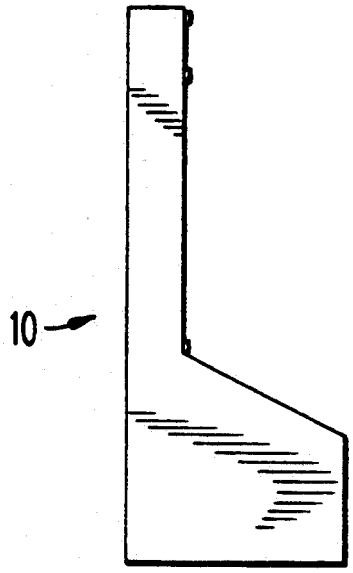
FIG. 2 is a side view of the device of FIG. 1.
Figure 3:
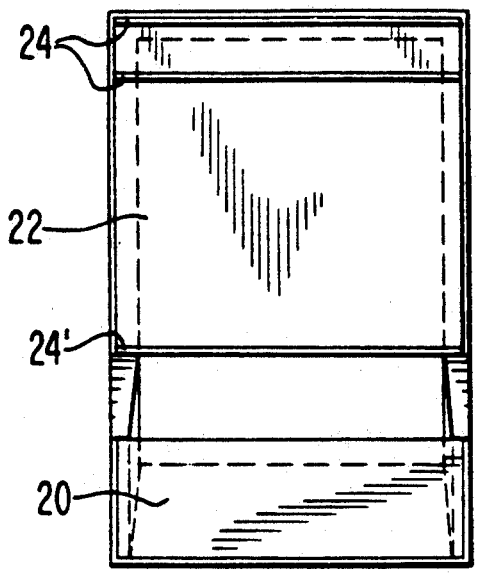
FIG. 3 is a front view of the device of FIG. 1.

Referring now to the drawings, and initially to FIG. 1 thereof, a preferred device for displaying and dispensing products in accordance with the present invention is generally designated by the reference numeral 10. As more fully described below, the device 10 is intended for use with a cardboard box 12 containing paint rollers, paint brushes or other products.

The device 10 comprises an integral frame 14, preferably comprised of opaque, semi-rigid plastic, such as polypropylene, defining lower and upper sections 26 and 28, respectively. The frame 14, which is open at the back, includes a continuous, rectangular wall 16 comprising a top 18, a bottom 20 and sidewalls 22, the sidewalls being enlarged at the lower section 26 of the device 10. As shown, the upper section 28 of the device includes an upper front wall portion 30 extending from the top wall 18 to the top of the lower section 26, the wall portion 30 preferably being glued to the frame 14 in a recessed surface defined in the front of the frame. The lower section 26 of device 10 includes a lower front wall portion 32 which, like the upper wall portion 30, is glued to the frame 14 in the aforementioned recessed surface defined in the front thereof. For reasons that will be apparent below, the lower front wall portion 32 is preferably separately formed of clear plastic. Owing to the enlarged sections 24 of the sidewalls 22, the front walls 30 and 32 of the upper and lower sections 28 and 26, respectively, are offset from each other for defining an opening 34 providing access to the compartment 36 defined by enlarged sidewall sections 24, lower front wall portion 32 and bottom 20. As preferred and shown, the tops of the enlarged sections 24 are sloped downwardly toward the front for enlarging the size of the opening 34 and permitting easier viewing of the products in the compartment 36.

As shown, metal extrusions 38, 40 and 42, e.g. polished aluminum, are secured, as by adhesive backing, to the upper front wall portion 30 in spaced parallel relation. The extrusions are of a conventional type formed with grooves for releasably retaining the edges of placards containing point-of-sale information and/or advertising, such as the placards 44 and 46. For example, the placard 44 may display the company or brand name and the placard 46 may display information about the product being dispensed. For this purpose, the extrusions 38 and 42 each have one groove and the extrusion 40 has two grooves, one on each side thereof.

Figure 4:
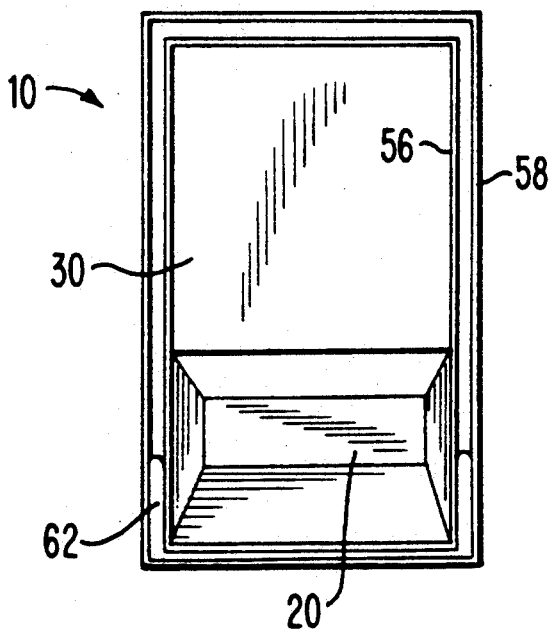
FIG. 4 is a back view of the device of FIG. 1.

As best seen in FIG. 4, the rectangular wall 16 has a finite thickness defined by inner and outer wall sections 56, 58, respectively, defining a hollow channel 60 therebetween. For reasons that will be apparent hereinafter, a U-shaped member 62, preferably also comprised of plastic, is secured in the lower part of the channel 60. The member 62 may, for example, be glued into place in the channel 60.

As noted, the device 10 is intended for use with a cardboard box 12 containing the products to be dispensed. For this purpose, the device 10 is dimensioned for a close fit about the front face of the box 12, excepting that the device 10 is preferably somewhat taller than the box to facilitate removal of the device 10 from the box 12 once all the products therein have been dispensed. As will be apparent from FIG. 1, when the device 10 is fitted about the box 12, the front of the bottom of the box seats on the bottom 20 of the frame 14 and the front portions of the sides of the box are in close spaced relation with the sidewalls 22 thereby releasably mating the device 10 to the box 12. When the device 10 is fitted to the box 12, the forwardmost position of the box is defined by contact between the front of the box and the upper front wall portion 30 of the device 10. It will now be apparent that the insert 62 prevents the inner wall section 56 of frame 14 from collapsing against the outer wall section 58 due to the weight of the box 12 seating on the bottom 20 of the frame 14. In a preferred embodiment for use with a box 12 which is about 12½" wide, about 14" high and about 14¼" deep the device 10 has an internal width of about 13¾" and a height of about 17¾". Of course, the exact dimensions of the device 10 will depend on the box 12 with which it is employed, but it is contemplated that the device will be manufactured in a few standard sizes for use with standard size shipping boxes.

As best shown in FIG. 1, a lower panel 50 of the front face 48 of the box 12 is preferably defined by perforations 52 to facilitate its removal for defining an opening in the front of the box prior to fitting the device 10 in place. It will be apparent that once the panel 50 of the box 12 is removed and the device 10 fitted in place, the products in the box 12 will be accessible through the opening 34. Preferably, means are provided for facilitating transfer of products in the box 12 to the compartment 36 for easy access through the opening 34, such that the compartment is constantly replenished with products from the box 12 until the box is emptied. For example, the shelves on which the boxes 12 are stored may be slanted forward for moving the products into the compartment 36 under the influence of gravity. In another embodiment, the same effect is accomplished by providing the box 12 with a slanted bottom section 54. It will now be apparent that the lower front wall section 32 of the device 10 is preferably transparent to permit an immediate view of the products in the box 12, which aids both customers and inventory control personnel. Also, to prevent the products from simply spilling out of the compartment 36, the lower front wall portion is preferably at least half as high as the height of the opening in the box 12, and most preferably almost equally as high.

As noted earlier, the device 10 is particularly intended for use in warehouse shopping clubs which provide shoppers with discount prices at a few large, spartan facilities typically containing little more than row upon row of shelving for displaying merchandise, usually in the original box in which the merchandise is shipped. Accordingly, in the case of products such as paint brushes, paint rollers and the like which are shipped in quantity in boxes 12, in the absence of the device 10 the box 12 would simply be placed on a shelf with, for example, the top of the front face opened such that customers could reach inside and remove the article to be purchased. Plainly, such an approach does little to attract the consumer to the article or inform him/her about it, with a consequent loss in sales. The device 10 overcomes these problems simply, efficiently and effectively.

In accordance with the invention, when a box 12 arrives, it is placed on a shelf, the front panel 50 removed, and the device 10 fitted over the front of the box. The result, in less than a minute, is an attractive and informative display. As the boxes 12 are typically arranged side by side on the shelves, all the consumer sees is the display device 10, i.e. the usually bland box behind the display is not readily visible especially where, as is preferred here, the display device 10 is somewhat higher than the box 12. When the products in the box 12 are depleted, the device 10 is removed, a new box is moved into position, its front panel 50 removed, and the device 10 is once again fitted in place whereupon "restocking" is completed. During this procedure, removal of the device 10 from the box 12 is facilitated by the increased height of the device 10 relative to the box 12 which allows the stock person to grip the top wall 18 of the frame 14 and pull the device off the box. Where the shelves are deep enough, the boxes 12 may be stocked one behind the other such that when the front box is depleted and removed, the box behind it is simply slid forward, its panel 50 removed and the device 10 fitted in place. From the foregoing, it will be apparent that instead of removing the panel 50, the entire front face of the box 12 may be removed, as the upper front wall section 32 will, in any event, cover the top of the front face of the box. Of course, the device 10 may be used with different products by simply changing the placards 44, 46.

While I have herein shown and described the preferred embodiment of a device in accordance with the present invention and suggested certain changes and modifications thereto, those of ordinary skill in the art will recognize that still further changes and modifications may be made therein without departing from the spirit and scope of the invention. Accordingly, the above description should be construed as illustrative and not in a limiting sense, the scope of the invention being defined by the following claims.

I claim:

1. A device for displaying and dispensing products, said device being usable with a box containing said products and having a first opening in a front wall thereof sufficient to pass said products, said device comprising:

a frame removably matable to said box over said opening, said frame defining a rear opening communicating with said first opening in said box and including a lower front wall portion spaced from the front wall of said box and extending upward from the bottom of said frame for defining an open compartment between said front wall of said box and said lower front wall portion of said frame, said compartment being in communication with said rear opening in said frame whereby products from said box pass through said first opening and said rear opening into said open compartment for removal therefrom.

2. The device of claim 1, wherein said first opening in the front wall of the box is in the bottom of the front wall, wherein the height of the lower front wall portion of the device is at least half as high as the height of the first opening in the front of the box, and wherein said frame further comprises a pair of sidewalls fitable about the front portions of the sides of said box and a bottom wall abutting the bottom of said box when said frame is fitted over said opening for releasably mating said device to said box.

3. The device of claim 2, wherein said device further comprises means for securing written material to said frame.

4. The device of claim 3, wherein said means for securing written material to said frame comprises means for securing said material to said frame above said lower front wall portion.

5. The device of claim 2, wherein said frame includes an upper front wall portion in close confronting relation with the front wall of said box when said device is releasably mated thereto.

6. The device of claim 5, further comprising means for securing written material to said upper front wall portion of said frame.

7. The device of claims 6, wherein said means for securing written material to said upper front wall portion comprises at least one extrusion secured to said upper front wall portion and configured to receive the edge of a planar member bearing said written material.

8. The device of claim 2, wherein said frame includes an upper front wall portion and a top wall, said upper front wall portion being in close confronting relation with the front of said box and said top wall being in spaced relation from the top of said box when said frame is releasably mated thereto, and wherein the lower portions of said sidewalls are enlarged and joined at their respective front ends to said lower front wall portion of said frame.

9. The device of claim 8, wherein said lower front wall portion is transparent.

10. The device of claim 8, further comprising said box, and wherein said box has a bottom surface angled downward toward the front thereof whereby products in said box are transported by gravity along said bottom surface towards said compartments.

11. The device of claim 10, wherein said lower front wall portion is transparent.

12. The device of claim 8, further comprising means for securing written material to said upper front wall portion of said frame.

13. The device of claim 12, wherein said means for securing written material to said upper front wall portion comprises at least one extrusion secured to said upper front wall portion and configured to receive the edge of a planar member bearing said written material.

14. The device of claim 8, wherein the upper edges of the enlarged lower portions of the sidewalls of the frame slope downward from the bottom of the upper front wall portion to the top of the lower front wall portion.

15. The device of claim 2, wherein said lower front wall portion is transparent.

16. The device of claim 1, further comprising said box, and wherein said box has a bottom surface angled downward toward the front thereof whereby products in said box are transported by gravity along said bottom surface towards said compartment.

* * * * *